US008061090B2

(12) United States Patent
Sourlis

(10) Patent No.: US 8,061,090 B2
(45) Date of Patent: Nov. 22, 2011

(54) CAVITY-WALL CONSTRUCTION WITH INSECT BARRIER

(76) Inventor: Tom Sourlis, Highland, IN (US)

( * ) Notice: Subject to any disclaimer, the term of this patent is extended or adjusted under 35 U.S.C. 154(b) by 415 days.

(21) Appl. No.: 11/960,549

(22) Filed: Dec. 19, 2007

(65) Prior Publication Data

US 2009/0158675 A1 Jun. 25, 2009

(51) Int. Cl.
*E02D 19/00* (2006.01)

(52) U.S. Cl. ..... 52/169.5; 52/379; 52/562

(58) Field of Classification Search ..... 52/101, 52/169.5, 302.1, 302.3, 310, 379–383, 513, 52/562, 565

See application file for complete search history.

(56) References Cited

U.S. PATENT DOCUMENTS

| | | | | |
|---|---|---|---|---|
| 3,754,362 | A * | 8/1973 | Daimler et al. | 52/169.5 |
| 5,343,661 | A * | 9/1994 | Sourlis | 52/169.5 |
| 6,588,158 | B2 * | 7/2003 | Nickell et al. | 52/101 |
| 2001/0023564 | A1 * | 9/2001 | Phillips | 52/302.1 |

* cited by examiner

*Primary Examiner* — William Gilbert
(74) *Attorney, Agent, or Firm* — McDonnell Boehnen Hulbert & Berghoff LLP

(57) ABSTRACT

An improved device for use in a cavity-wall construction includes a water-permeable body yielding a first-average opening size that is large enough to permit water to pass therethrough, but small enough to substantially prevent mortar and other debris from passing therethrough. The device includes a water-permeable material likewise adapted to permit water to pass therethrough, but also forms a barrier to insects which are of an effective size that is much smaller than the first-average opening size.

19 Claims, 6 Drawing Sheets

CAVITY-WALL CONSTRUCTION WITH INSECT BARRIER

FIELD OF THE INVENTION

This invention generally relates to improved devices for use in cavity-wall constructions. In particular, insects may enter into a building via the cavity-wall construction. This invention more specifically relates to devices that substantially prevent insects (or small creatures, more generally) of an effective size from passing through the cavity-wall construction.

BACKGROUND OF THE INVENTION

The present invention found its origin in so-called masonry cavity-wall constructions. Masonry cavity walls have inner and outer vertical walls. The inner wall may be constructed from wood, with an inner surface of drywall, structural clay tile, vertical stacks of mortared bricks, or a shear concrete surface, as examples. The outer wall is generally constructed from vertical stacks of bricks that are held together by mortar. A space, or cavity, exists between the two walls, and the cavity may be partially filled with insulation. The space defining the cavity wall may be anywhere between 2 to 4.5 inches, as an example.

Typically, water may collect in the cavity between the inner and outer wall. To drain water within the masonry cavity wall, weep holes are commonly placed along the base of the outer wall. The weep holes allow water to pass from the cavity to drain outside the wall structure.

During construction of a masonry cavity wall, excess mortar and other debris can and does fall between the inner and outer wall. When the bricks are stacked during the erection of the outer wall, for example, mortar droppings are squeezed into the space between the walls. The excess mortar, as well as other debris, may drop to the base of the cavity and block the weep holes.

To prevent mortar or debris of any significant size from reaching and thus blocking a given weep hole, devices have been designed that can rest on the base of the wall cavity to cover and protect the weep holes, for instance. Such are shown in U.S. Pat. No. 5,230,189 and U.S. Pat. No. 5,343,661, as examples. As a further measure, a weep-vent wick may be placed within a weep hole itself to facilitate water removal. By preventing mortar and other debris from entering and thus blocking the weep holes, the devices facilitate the free flow of moisture from the cavity to the building exterior.

Although the mortar-net and weep-vent devices may prevent mortar and other debris from blocking the weep holes, such devices may be ineffective in preventing insects of an effective size from passing through the cavity-wall construction and thus entering the building. This may be an issue in particular for buildings such as hospitals and restaurants.

SUMMARY

In accordance with an embodiment, an improved mortar-and-debris-catching device for use in a cavity-wall construction is disclosed. The device includes a first water-permeable body that yields a first-average opening size that is large enough to permit water to pass therethrough, but small enough to substantially prevent mortar and other debris from passing therethrough. The first body includes such a water-permeable portion that is, at least in part, capable of being placed to cover, such as by overlying, at least one weep hole. The device also includes a water-permeable material that is further adapted to act as a barrier to insects which are of an effective size that is smaller than the first-average opening size (for debris capture).

The debris-catching body may be a mesh material or a fabric material, as examples. The barrier material may be of a similar material, with a second-average opening size that is smaller than the first-average opening size. The barrier material may alternatively be of a completely different material, such as a screen.

The barrier material may be heat bonded and/or glued to the water-permeable body. In some instances, the water-permeable material further includes an insect repellant and/or an insecticide application.

In accordance with another embodiment, an improved weep-hole device for use in a cavity-wall construction is disclosed. The device includes a water-permeable body that is positioned within a weep hole, with an opening size that is large enough to permit water to pass therethrough, but still small enough to substantially prevent mortar and other debris from passing therethrough. This embodiment also can include a debris-catching material that is coupled to the weep-hole body, and substantially covers a cross-sectional area of the weep hole.

As noted, the water-permeable material may be a mesh material or a fabric material, as examples. In some cases, the barrier material is positioned on an exterior surface of the debris-catching body. It is presently considered that a barrier material that is two or more orders of magnitude smaller in opening size than the first opening size (i.e., the of the debris-catching body) is desirable, and more preferably three or more orders of magnitude.

These as well as other aspects and advantages will become further apparent to those of ordinary skill in the art by reading the following detailed description, with reference where appropriate to the accompanying drawings.

BRIEF DESCRIPTION OF THE DRAWINGS

Embodiments are described below in conjunction with the appended drawing Figures, wherein like reference numerals refer to like elements in the various figures, and wherein.

DETAILED DESCRIPTION

Figure 1:
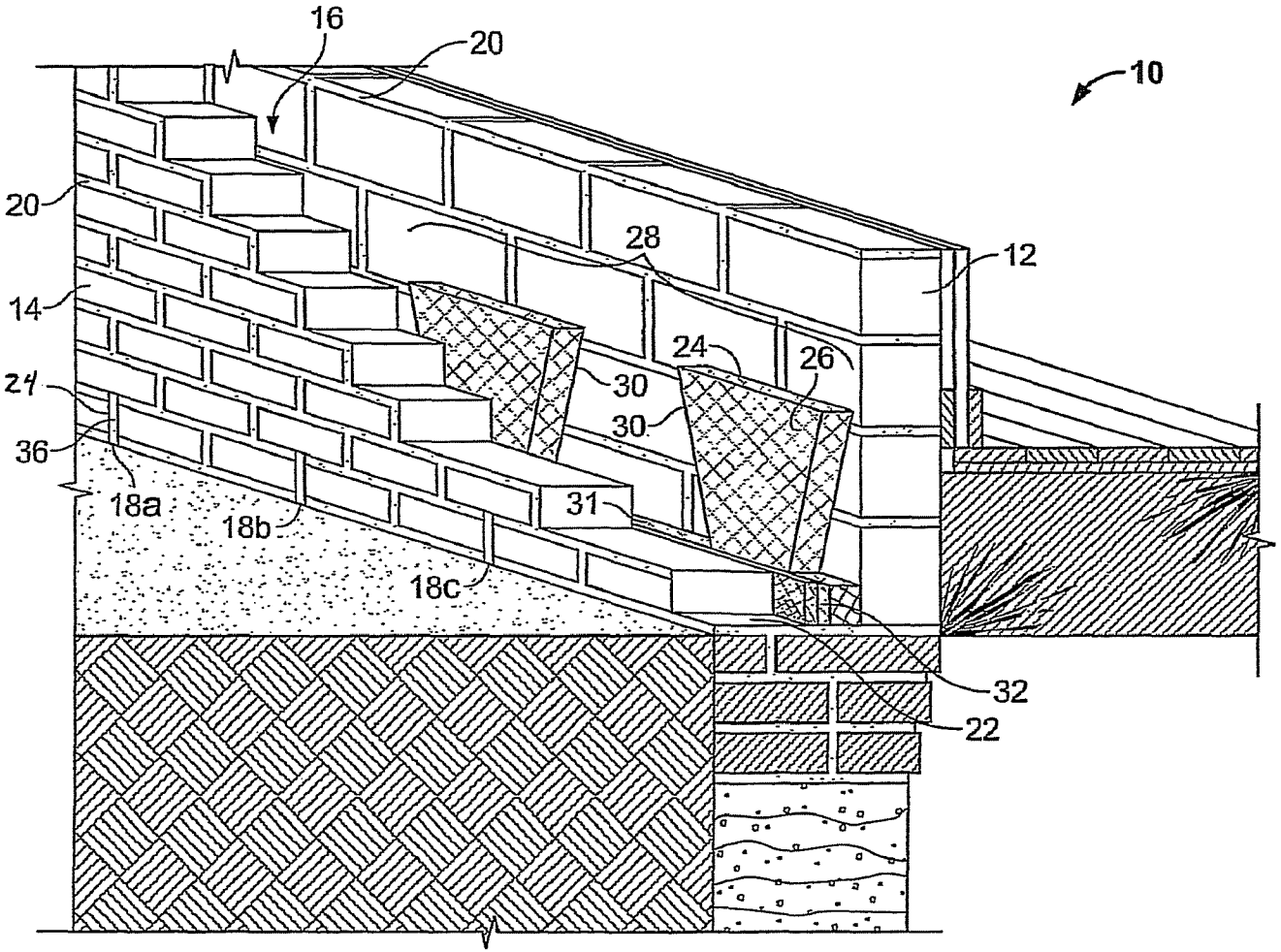
FIG. 1 is a perspective view of a cavity-wall construction partly in section.

Brick masonry cavity walls 10, as shown in FIG. 1, typically consist of two wythes of masonry separated by an air space. The interior masonry wythe (the inner wall) 12 may be solid brick, hollow brick, structural clay tile, wood or hollow or solid concrete masonry units, as examples. The exterior masonry wythe 14 (the outer wall) may be likewise formed, but most often solid brick. The cavity 16 between the two wythes may be either insulated or left open as air space. The cavity has a typical width of about 2 to about 4.5 inches, but could be smaller (although non-standard).

A common problem associated with a cavity-wall construction is how to allow moisture, as from seepage or condensation, to pass from the cavity to outside the wall. Weep holes 18*a*, 18*b*, 18*c* creating an unobstructed opening passing from the cavity to the outside of the wall, are provided to this end. Generally, the weep holes 18*a*, 18*b*, 18*c* will be placed approximately two feet apart at the base of the outer wall 14. Moisture collecting in the cavity is intended to run down the cavity wall and be directed, as by a flashing device (not depicted), toward the weep holes 18*a*, 18*b*, 18*c*. The flashing device may be composed of any of a variety or combination of materials, such as sheet metals, bituminous membranes, plastics, and/or vinyls.

In some examples, a cotton wick (not depicted) may be placed within a weep hole extending into the cavity. The moisture from inside the cavity will be absorbed and passed to the other end of the wick. The end of the wick is left outside the wall to let the moisture evaporate outside the wall.

In the course of construction of a cavity wall 10, mortar 20 and other debris will commonly fall into the cavity 16 between the inner wall 12 and outer wall 14. In particular, mortar and debris may fall all the way to the base of the wall 22, where the weep holes 18*a*, 18*b*, 18*c* are located. Because there is no easy access to the interior of the cavity 16, mortar and debris falling within the cavity 16 is not readily removable. If enough mortar 20 builds up around the weep holes, or if it simply lodges in the weep holes, the weep holes 18*a*, 18*b*, 18*c* will become plugged, causing water to pond between the walls 12 and 14. The water can then leak into the structure and thus cause cracking, deterioration and/or discoloration of the walls.

To prevent the weep holes 18*a*, 18*b*, 18*c* from becoming plugged by mortar and other debris, a fibrous body 24 may rest on the base 22 of the cavity 16 between the inner wall 12 and the outer wall 14, covering at least one weep hole. The width of the body 24 is roughly determined by the width of the cavity 16. The body 24 includes a portion 32 that covers at least one of the weep holes 18*a*, 18*b*, 18*c*. It should be noted that this "portion" can be the entire body or just a part thereof. The debris-blocking function also need not be effected adjacent the weep hole itself, but can be further up in the cavity. That function, as well as the insect-barrier to be hereafter described, can be accomplished beyond the immediate area of the weep hole. However, it is typically most easy to have the body placed (resting) at the base of the cavity, thereby blocking the weep-hole proper.

The body 24 may take any of a variety of shapes. As an example, the body 24 may have a generally rectangular shape with a flat bottom edge that will rest flush on the cavity base and against the wall 14. It may be inclined, so as to span the distance between wythes with less material. As another example, the body 24 may include trapezoidal-like cutouts 28. Two slanted edges 30 of the body 24 and a bottom edge 31 of the body (the latter running roughly parallel to the longitudinal axis of the body 24) define the cutout 28. The dovetailed cutouts 28 thereby formed in the body 24 yield protrusions which help break up the mortar and other debris falling thereon to prevent ponding of moisture in the mortar and debris that collect on the collection device surface. The overhangs formed by the slanted sides 30 are intended to assure that gaps remain in fallen mortar and debris for water to progress to the body 24.

The body 24 may be composed of a variety of materials. As an example, the body 24 may be composed of a non-absorbent plastic, such as the filament-type plastic (used to surface walk-off mats, for instance). These materials are preferred because they are water-impervious, relatively inexpensive, and can be formed into cuttable blocks or sheets. A quantity of these materials is formed in a mass of random fibers with a density that is sufficient to catch and support mortar and other debris thereon without significant collapse, but allow water to pass freely therethrough. Of course, the body 24 may be composed of another material (or combination of materials) as well.

The porosity of the body 24 made from the fibrous material can be quite varied, so long as it effectively serves to strain out the mortar and debris before it reaches the weep holes. Most mortar and debris will be quite large, i.e., greater than ⅛ or 1/16 of an inch or clearly visible to the naked eye, and a porosity sufficient to catch such relatively large particulate matter will suffice to prevent plugging of the weep holes. In particular, the body 24 may yield an average opening size 26 (shown schematically) that is large enough to permit water to pass therethrough, but small enough to substantially prevent mortar and other debris from passing therethrough.

The average opening size 26 may define a threshold size that an object may take and still pass through the body 24. The average opening size 26 may be measured by a volume, area, and/or one-dimensional length (or height or width), as examples. Correspondingly, the size of an object may be measured by the volume of the object (e.g., a product of the object's height, length, and width), a cross-sectional area of the object (e.g., a product of any two of the object's height, length, and width), or any one of the object's height, length, and width.

Mortar and other debris will be highly irregular in shape and typically large in at least one dimension. Thus, any one of an object's height, length, and width may vary from one portion of the object to the next. Hence, the object may define more than one cross-sectional area, for example, with each cross sectional area including a unique height, length, and/or width. For purposes of determining a threshold size for an object, herein as it relates to insects, for instance, the largest of the object's height, length, and/or width along a radial diameter (i.e., orthogonal to its length) may be best used to determine the object's effective volume, cross-sectional area, or one-dimensional length.

To illustrate, if the average opening size 26 is 20 $mm^2$ (i.e., an area), then an object whose largest cross-sectional area (e.g., the product of the object's largest width and largest height) is 20 $mm^2$ or less may pass through the body 24, while an object whose largest cross-sectional area is greater than 20 $mm^2$ will be prevented from passing through the body 24. For ranges, the average opening size 26 may be anywhere between 1 $mm^3$ and 25 $mm^3$ (if a volume), 1 $mm^2$ and 25 $mm^2$ (if an area), and/or between 1 mm and 25 mm (if a one-dimensional length). Of course, other definitions and sizes exist for the average opening size 26.

The body 24 may be affixed within the cavity 16 in any of a variety of ways. For example, a cotton wick (not depicted) may be attached to, or formed with, the body 24 to aid in the passage of water from the wall. The wick can help serve to hold the body 24 in place. When used with such an integral wick, the body 24 would be emplaced when the wick holes were formed. Alternatively, the body 24 will simply be set at the base 22 of the wall foundation covering the weep holes

18*a*, 18*b*, 18*c*, without the need of any fixation device. A flashing device (not depicted) can furthermore be directly attached to the bottom and/or back of the body 24.

As noted earlier, besides being emplaceable on the base 22 of the cavity 16, the body 24 may be placed on wall tie rods (not depicted) above the base 22. The tie rods are often part of the cavity wall structure, tying the inner wall 12 and the outer wall 14 together. Further, the body 24 may include reinforcing rods (not depicted) extending along the bottom of the body 24 to support and better distribute weight on the body 24 when not simply resting on the base 22. The reinforcing rods may better enable the body 24 to span adjacent tie rods and still work effectively.

To further prevent the weep holes 18*a*, 18*b*, 18*c* from becoming plugged by mortar and other debris, a fibrous body 24 may be placed within any one of the weep holes 18*a*, 18*b*, 18*c*. The body 24 may substantially fill a given weep hole (e.g., weep hole 18*a* as shown in FIG. 1). Preferably, the body 24 yields an average opening size 36 (again shown schematically) that is large enough to permit water to pass therethrough, but small enough to substantially prevent mortar and other debris from passing therethrough. The average opening sizes 26 and 36 may be the same or vary from one another, and similarly, the respective densities of the bodies 24 and 34 may be the same or may vary from one another.

Although the body 24 may help prevent mortar and other debris from clogging the weep holes 18*a*, 18*b*, 18*c*, they may not prevent insects (or small creatures, more generally) of an effective size from passing through the cavity-wall construction 10, and entering into the building. As examples, insects such as ants, termites, and certain spiders (or any other type of insect or creature smaller than the average opening sizes 26 and/or 36) may enter into the building by passing through the body 24.

Figure 2:
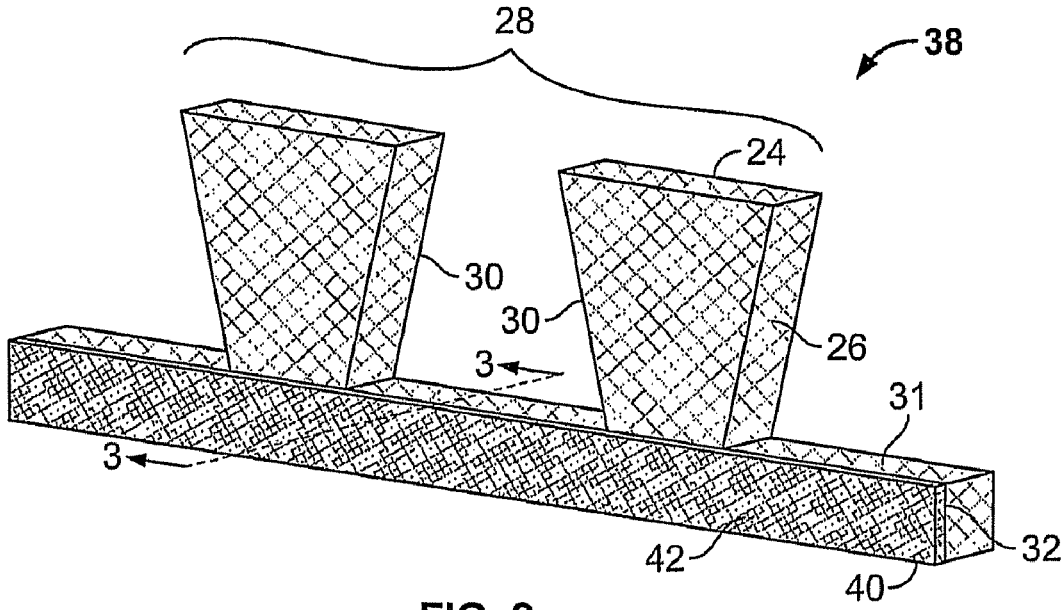
FIG. 2 is a perspective view of an improved mortar-and-debris-catching device, made in accordance with the teachings of the invention.

FIG. 2 is a perspective view of an improved mortar-and-debris-catching device 38 of an embodiment of this invention. As shown, mortar-and-debris-catching device 38 includes the body 24 and a barrier material 40. The barrier material 40 is adapted to (i) permit water to pass therethrough, and (ii) form a barrier to insects which are of an effective size that is smaller than the average opening size 26.

Figure 3:
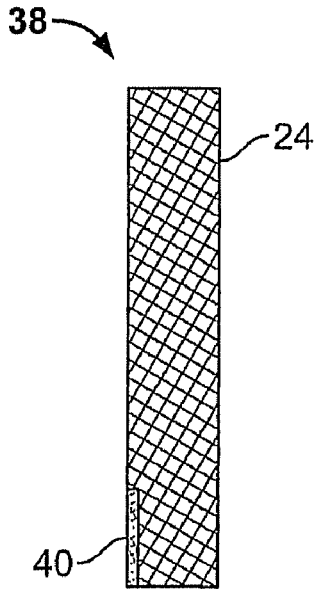
FIG. 3 is a cross-sectional view along line 3-3 of the improved mortar-and-debris-catching device of FIG. 2.
Figure 4:
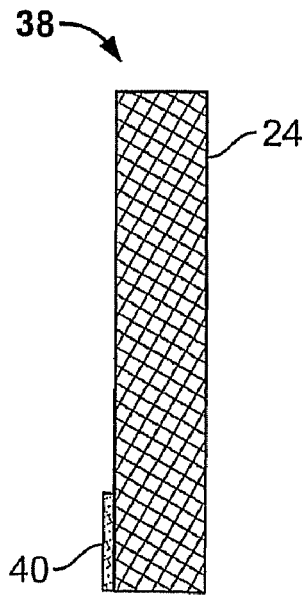
FIG. 4 is a cross-sectional view, similar to that of FIG. 3, of a modified version of the mortar-and-debris-catching device, made in accordance with the teachings of the invention.
Figure 11:
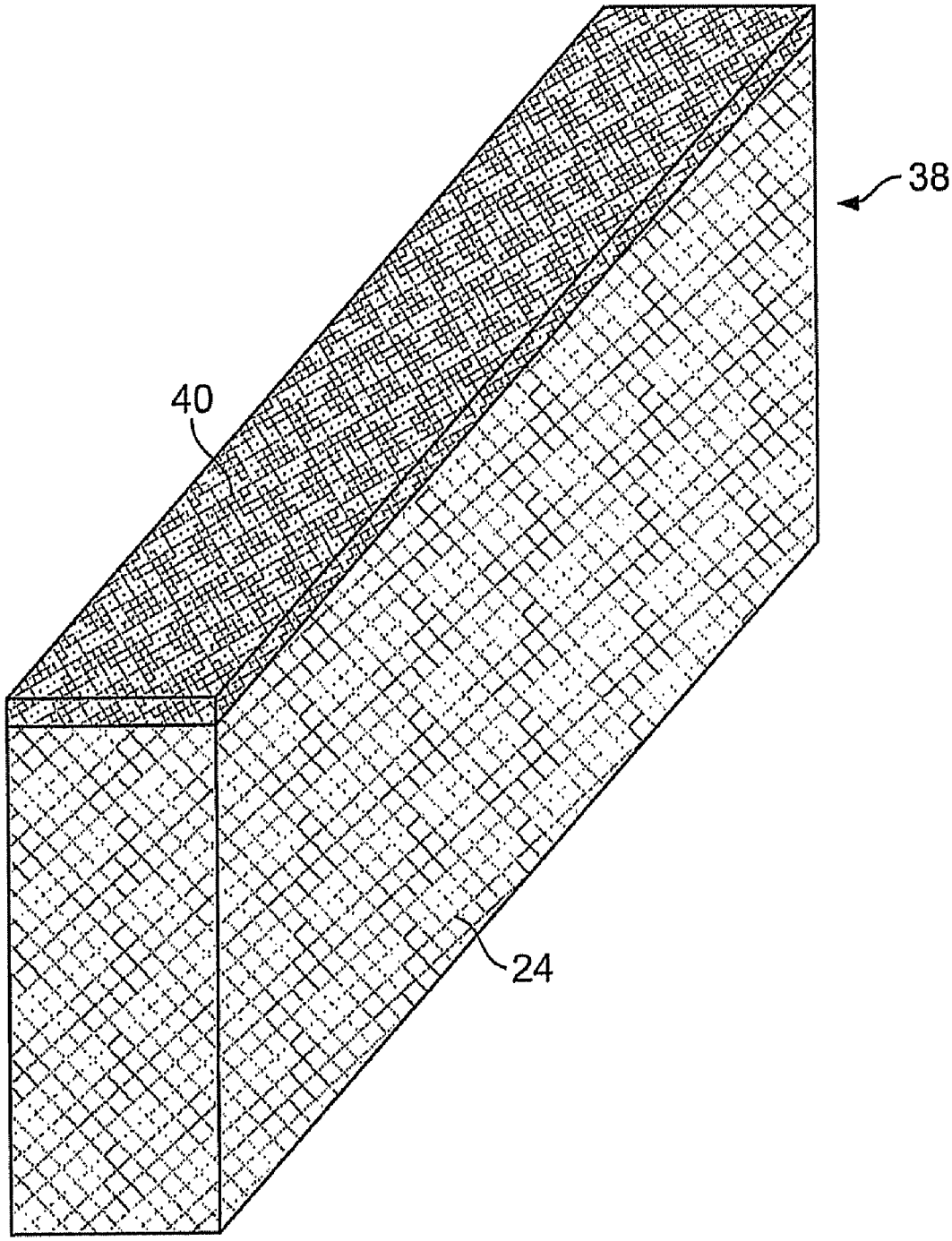
FIG. 11 is another embodiment in perspective view, made in accordance with the teachings of the invention.

The barrier material 40 may be provided with the body 24 in any of a variety of ways and positions. As shown in FIG. 2, the barrier material 40 is provided at the portion 32 of body 24 covering the weep holes 18*a*, 18*b*, 18*c*. To further illustrate, FIG. 3 is a cross-sectional view of the improved mortar-and-debris-catching device 38. As shown, the barrier material 40 is provided slightly within but still on the exterior surface of the body 24, so as to be facing (adjacent) the weep holes. Alternatively, as shown in FIG. 4, the barrier material 40 is provided on the body 24 (if a thin scrim or screening, it will add little to the overall width of the body 24). When provided within the body 24, the barrier material 40 may be positioned in any of a variety of angles and/or curves. As other examples, the barrier material 40 may cover the entire side of the body 24 facing the outer wall 14, or completely cover the body 24. It could be located horizontally across the body 24 instead of vertically (as in FIGS. 2 though 4). This horizontal placement shown in FIG. 11 would not require the body to be oriented for effective use of the barrier. Of course, other examples exist for the position of the barrier material 40.

When placed within the cavity 16, the body 24 and barrier material 40 may cooperatively have a thickness dimension substantially the same as the cavity 16 between the inner and outer walls 12 and 14. If the barrier material 40 is positioned on the exterior surface of the body 24, then the body 24 and/or barrier material 40 may slightly compress to allow the portion 32 of the body 24 and the barrier material 40 to fill the cavity 16. The thickness of the barrier material 40 may range from 0.5 to 1.5 centimeters, as an example.

Figure 12:
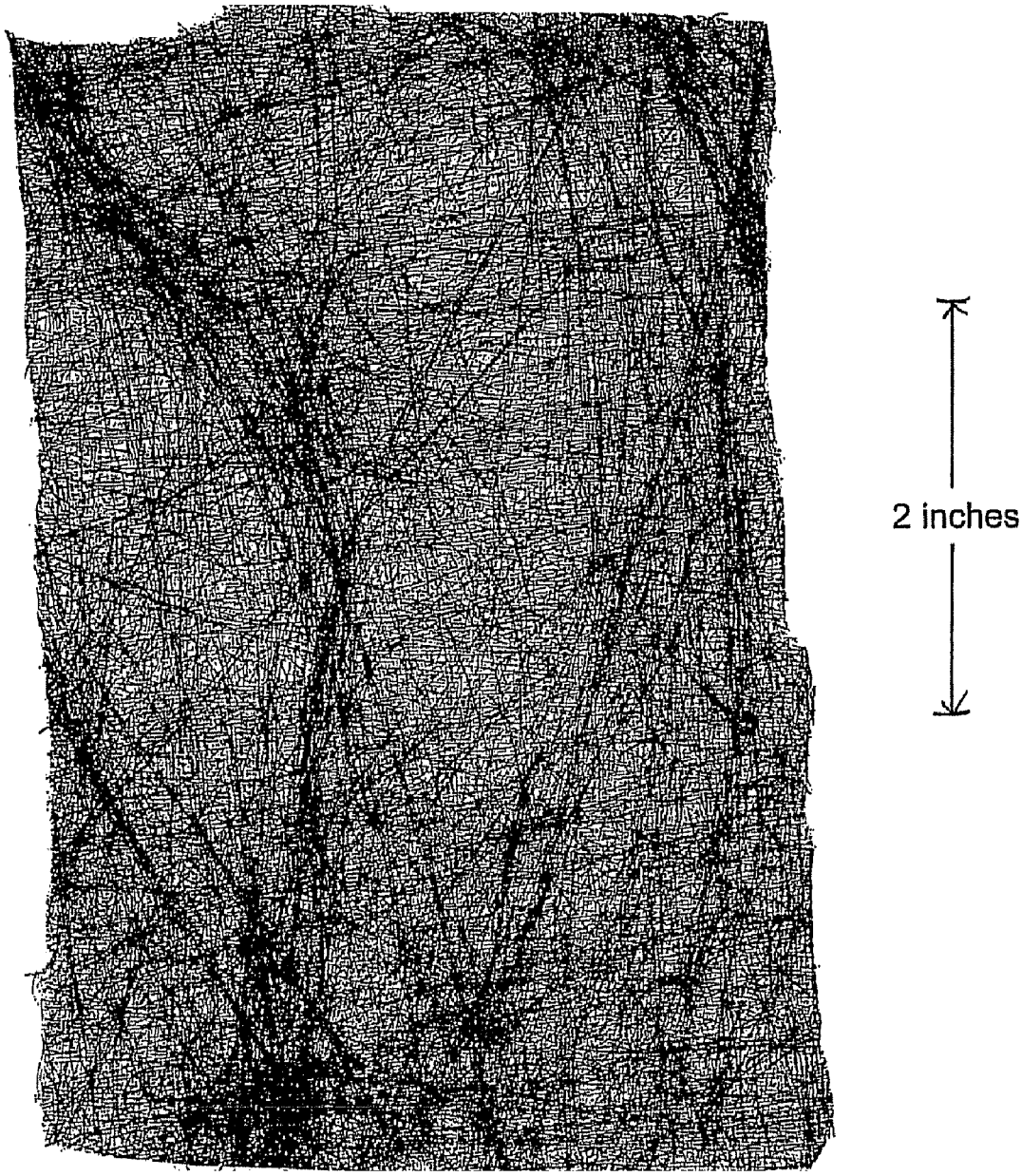
FIG. 12 is an actual sample of a preferred barrier material shown to scale.

The barrier material 40 may be composed of any of a variety of materials. For instance, the barrier material 40 may be composed of a non-absorbent plastic. More generally, the barrier material 40 may include a non-water absorbent randomly oriented fibrous material, or a plurality of circuitous non-linear pathways, as examples. Alternatively, the barrier material 40 may be composed of a fabric material, such as REEMAY, which is a spun-bonded polyester material that is supplied by Fiberweb, Inc., of Old Hickory, Tenn.; an actual sample of which is reproduced to scale in FIG. 12. Of course, other examples exist for the barrier material 40 (e.g., a combination of different materials).

The barrier material 40 should yield an average opening size 42 that is much smaller than the average opening size 26. As examples, the average opening size 42 may range 0.5 $mm^2$ to 10 $mm^2$ (if an area). To illustrate, if the average opening size 42 is 5 $mm^2$ (i.e., an area), for instance, then insects that have an effective size that is larger than 5 $mm^2$ will be prevented from passing through barrier material 40. In some instances, an average opening size 42 of 0.1 mm (or 0.1 $mm^2$) is desirable, and in other instances, an average opening size 42 of 0.01 mm (or 0.01 $mm^2$) is desirable. Of course, other examples exist for the average opening size 42.

The effective size of an insect may include the volume of the insect (e.g., a product of the insect's height, length, and width), a cross-sectional area of the insect (e.g., a product of any two of the insect's height, length, and width), or any one of the insect's height, length, and width. Since insect's height, length, and width may vary from one portion of the insect to the next, the largest of the insect's height, length, and/or width may be used to determine the insect's volume, cross-sectional area, or one-dimensional length.

Further, the height, length, and/or width of the insect may be measured by any of a variety of body parts, such as its body (e.g., head, thorax, and abdomen), the span of its legs, the span of its wings, or by any other part, and by any combination of the above parts. Put simply, and including legs, antennas, wings, and other features, it is the smallest size the bug in point can squeeze itself into and through.

It is presently considered that a barrier material 40 that is an order of magnitude smaller in opening size that the opening size 36 (i.e., the of the debris-catching body) is desirable, and more preferably two orders of magnitude.

The barrier material 40 may be coupled to the body 24 in any of a variety of ways. As examples, the barrier material 40 may be heat bonded and/or glued to the body 24. Alternatively, the barrier material 40 may be freestanding, and not affixed to the body 24.

As a further measure to prevent insects from passing through the cavity-wall construction 10, the barrier material 40 may further include an insect repellant and/or an insecticide. The barrier material 40 and the insect repellant and/or insecticide may be co-extruded, for example. As another example, the barrier material 40 may further include a fungicide and/or a mold repellant, and these chemicals may likewise be co-extruded with the barrier material 40, sprayed thereon, applied by a dip, and so forth.

Figure 5:
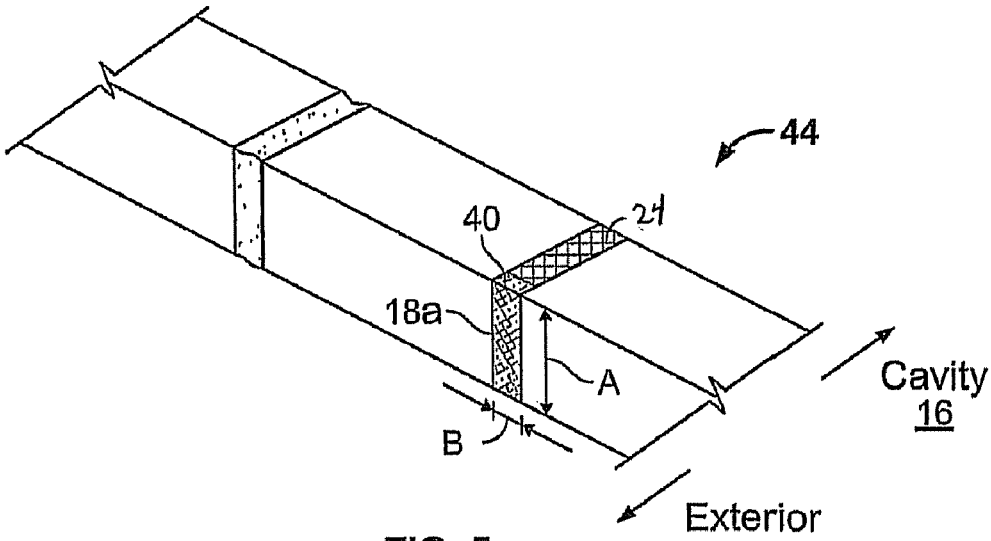
FIGS. 5-7 each include a perspective view of an improved weep-hole device, made in accordance with the teachings of the invention (shown for clarity just in a single row of bricks)
Figure 6:
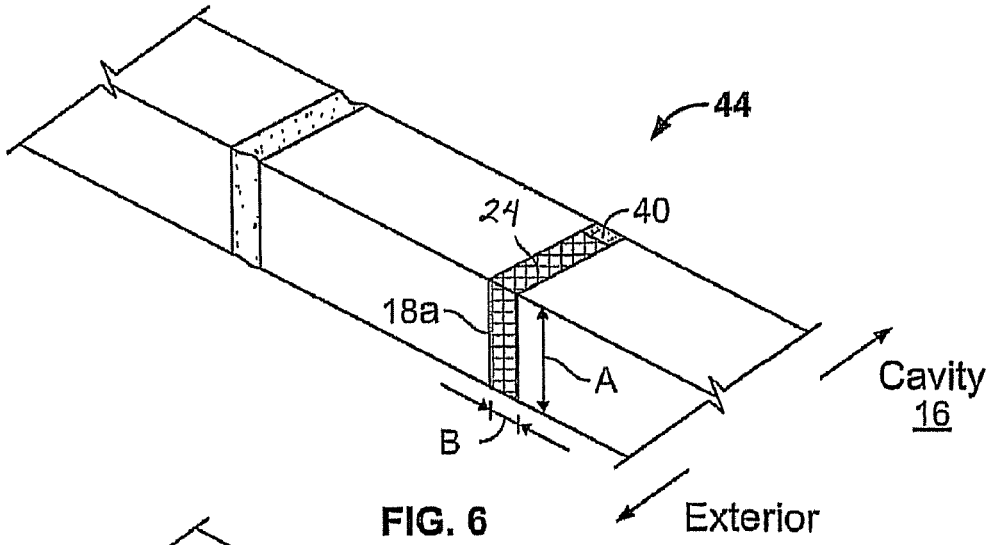
Figure 7:
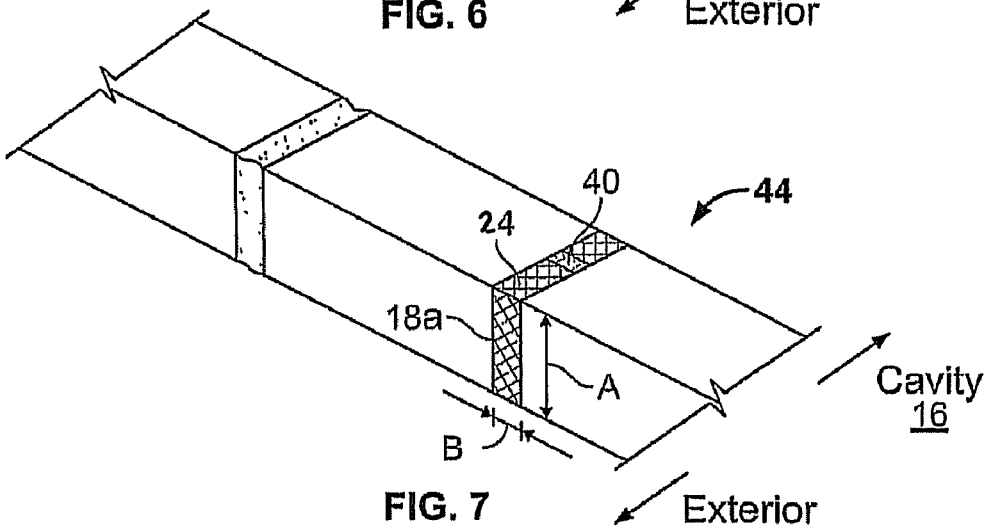

FIGS. 5-7 each include a perspective view of an improved weep-hole device 44 placed within the weep hole 18*a*. As shown, the improved weep-hole device 44 includes the body 24 and the barrier material 40.

Similar to that above, the barrier material 40 yields an average opening size 42 that is much smaller than the average opening size 36. Likewise, the barrier material 40 may be provided in any of a variety of positions for the device 44. As examples, the barrier material 40 may be positioned at the exterior surface of the body 24 facing the exterior of the building (as shown in FIG. 5), at the exterior surface of the body 24 facing the cavity 16 (as shown in FIG. 6), or provided within the body 24 (as shown in FIG. 7). In each case, the barrier material 40 preferably substantially covers the cross-sectional area (A×B) of the weep hole 18*a*.

Figure 8:
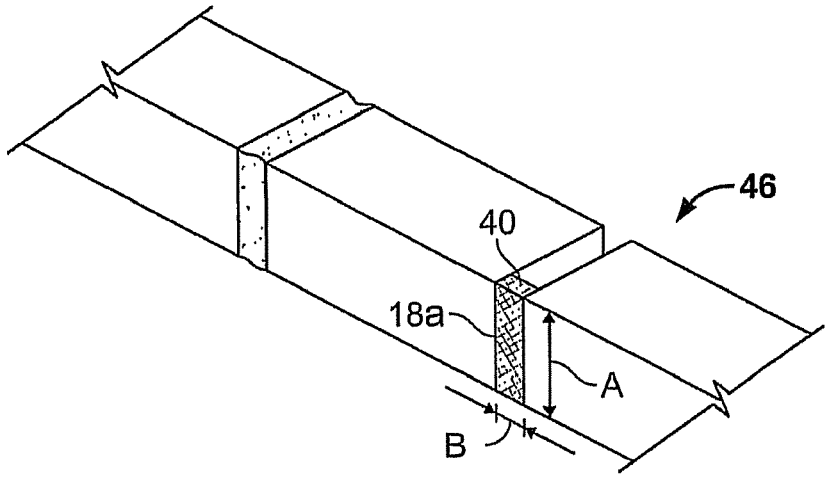
FIGS. 8-10 each include a perspective view of another improved weep-hole device, made in accordance with the teachings of the invention.
Figure 9:
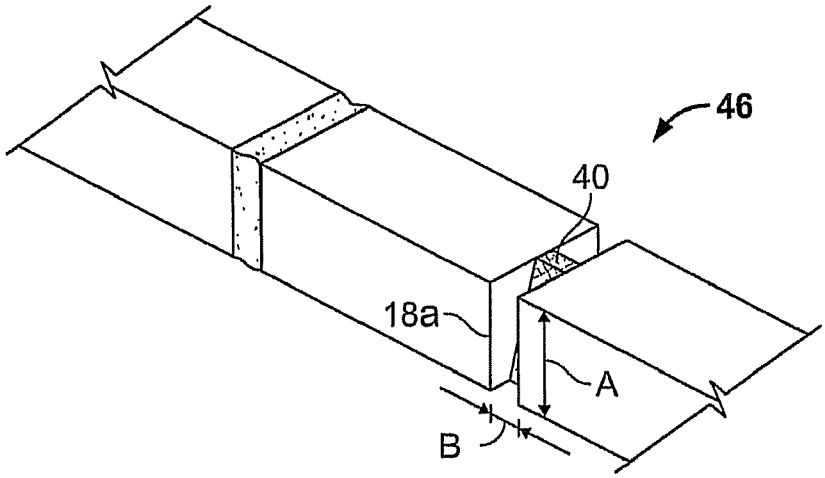
Figure 10:
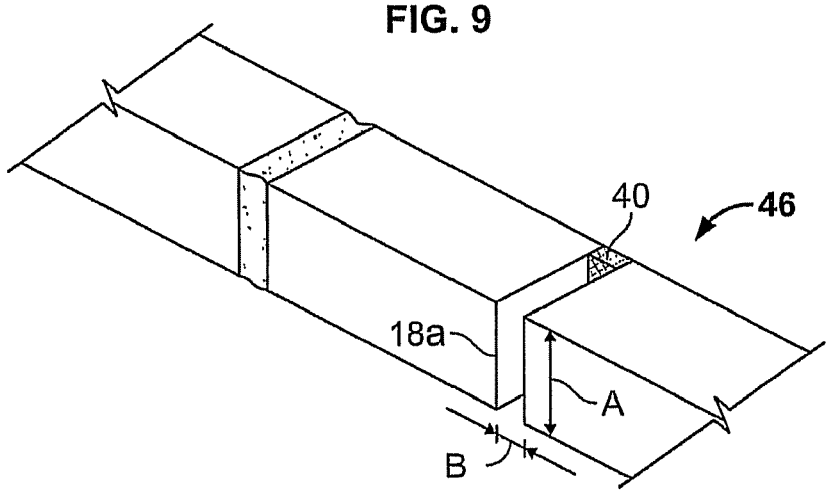

FIGS. 8-10 each include a perspective view of an improved weep-hole device 46 placed within the weep hole 18*a*. In these embodiments, the device 46 is made entirely of barrier material 40, and is placed within the weep hole 18*a* without a related body 24, and may be provided in any of a variety of positions. As examples, the barrier material device 46 may be positioned at the edge of the weep hole 18*a* facing the exterior of the building (as shown in FIG. 8), near the middle of the weep hole 18*a* (as shown in an angled position in FIG. 9), or at the edge of the weep hole 18*a* facing the cavity 16 (as shown in FIG. 10). Of course, other examples exist for the position of the barrier material device 46. So too, the barrier material devices 44 and 46 may be made part of the main fibrous body 24.

It should be understood that the illustrated embodiments are examples only and should not be taken as limiting the scope of the present invention. The claims should not be read as limited to the described order or elements unless stated to that effect. Therefore, all embodiments that come within the scope and spirit of the following claims and equivalents thereto are claimed as the invention.

I claim:

1. An improved mortar-and-debris-catching device for use above grade in a cavity-wall construction having weep holes, comprising:

(a) a water-permeable body having circuitous non-linear pathways therethrough yielding a first-average opening size that is large enough to permit water to pass therethrough, but small enough to substantially prevent mortar and other debris from passing therethrough, said body presenting a discontinuous upper surface at least in part, when placed in a cavity of the cavity-wall construction above grade to cover at least one weep hole; and (b) a water-permeable barrier material provided on said body, said material yielding a second-average opening size that permits water to pass therethrough, while forming a barrier to insects which are of an effective size that is smaller than said first-average opening size, wherein said second-average opening size is at least an order of magnitude smaller than said first-average opening size, wherein said second-average opening size is smaller than said effective size, and wherein said second-average opening size defines an area between approximately 0.01 $mm^2$ and approximately 10 $mm^2$.

2. The device as defined in claim 1, wherein said second-average opening is at least two orders of magnitude smaller than said first-average opening size.

3. The device as defined in claim 1, wherein the second-average opening size defines a one-dimensional length between 0.01 mm and 10 mm.

4. The device as defined in claim 1, wherein said effective size defines at least one of a volume, a cross-sectional area, and a one-dimensional length.

5. The device as defined in claim 1, wherein the effective size defines a one-dimensional length between 0.01 mm and 10 mm.

6. The device as defined in claim 1, wherein said body defines a first density, wherein said barrier material defines a second density, wherein said second density is at least twice that of said first density.

7. The device as defined in claim 6, wherein said body and barrier material are formed of the same material.

8. The device as defined in claim 1, wherein said barrier material includes a plurality of circuitous non-linear pathways.

9. The device as defined in claim 1, wherein said barrier material is a non-water absorbent randomly oriented fibrous material.

10. The device as defined in claim 1, wherein said barrier material is a fabric material.

11. The device as defined in claim 1, wherein the portion of said body and said barrier material cooperatively have a thickness dimension substantially the same as that of said cavity between an inner wall and an outer wall defining said cavity.

12. The device as defined in claim 1, wherein said material further comprises a compound selected from the group consisting of an insect repellant and an insecticide.

13. An improved weep-hole device for use above grade in a cavity-wall construction having weep holes, a weep hole defining a cross-sectional area, comprising:

(a) a water-permeable body having circuitous non-linear pathways therethrough positioned within said weep hole above ground, said body yielding a first-average opening size that is large enough to permit water to pass therethrough, but small enough to substantially prevent mortar and other debris from passing therethrough; and (b) a water-permeable barrier material on said body, said material substantially spanning the cross-sectional area of said weep hole, said material yielding a second-average opening size that (i) permits water to pass therethrough, and (ii) forms a barrier to insects which are of an effective size that is smaller than said first-average opening size, wherein said second-average opening size is at least an order of magnitude smaller than said first-average opening size, wherein said second-average opening size is smaller than said effective size, and wherein said second-average opening size defines an area between approximately 0.01 $mm^2$ and approximately 10 $mm^2$.

14. The device as defined in claim 13, wherein said second-average opening is at least two orders of magnitude smaller than said first-average opening size.

15. The device as defined in claim 13, wherein said body defines a first density, wherein said material defines a second density, wherein said second density is at least twice that of said first density.

16. The device as defined in claim 13, wherein said material is a fabric material.

17. The device as defined in claim 16, wherein said body defines an exterior surface, and wherein said barrier material is provided on the exterior surface of said body.

18. The device as defined in claim 13, wherein said material further comprises a compound selected from the group consisting of an insect repellant and an insecticide.

19. An improved mortar-and-debris-catching device for use above ground in a cavity-wall construction having weep holes, comprising:

(a) a water-permeable body having circuitous non-linear pathways therethrough yielding a first-average opening size that is large enough to permit water to pass therethrough, but small enough to substantially prevent mortar and other debris from passing therethrough, said body presenting a non-linear upper surface at least in part when placed in a cavity of the cavity-wall construction above ground to cover at least one weep hole; and (b) a water-permeable barrier material provided on said body, said material yielding a second-average opening size that permits water to pass therethrough, while forming a barrier to insects which are of an effective size that is smaller than said first-average opening size, wherein said second-average opening size is at least an order of magnitude smaller than said first-average opening size, wherein said second-average opening size is smaller than said effective size, and wherein said second-average opening size defines an area between approximately 0.01 $mm^2$ and approximately 10 $mm^2$.

* * * * *